US008816307B2

(12) United States Patent
Kuusela et al.

(10) Patent No.: US 8,816,307 B2
(45) Date of Patent: Aug. 26, 2014

(54) METHOD AND APPARATUS PERTAINING TO USE OF JAWS DURING RADIATION TREATMENT

(75) Inventors: Esa Kuusela, Espoo (FI); Sami Siljamäki, Helsinki (FI)

(73) Assignee: Varian Medical Systems International AG, Cham (CH)

( * ) Notice: Subject to any disclaimer, the term of this patent is extended or adjusted under 35 U.S.C. 154(b) by 553 days.

(21) Appl. No.: 12/837,123

(22) Filed: Jul. 15, 2010

(65) Prior Publication Data

US 2012/0012763 A1 Jan. 19, 2012

(51) Int. Cl.

| | |
|---|---|
| ***G21K 1/04*** | (2006.01) |
| ***G21K 1/02*** | (2006.01) |
| ***H01J 29/46*** | (2006.01) |

(52) U.S. Cl.

USPC ..... 250/505.1; 250/526; 378/147; 378/150; 378/152

(58) Field of Classification Search

USPC ..... 378/64, 65, 147, 150, 152, 157, 378/205–207; 250/252.1, 370.09, 505.1, 250/526

See application file for complete search history.

(56) References Cited

U.S. PATENT DOCUMENTS

| | | | | |
|---|---|---|---|---|
| 6,459,769 | B1 * | 10/2002 | Cosman | 378/147 |
| 6,577,707 | B2 * | 6/2003 | Siochi | 378/65 |
| 6,714,620 | B2 * | 3/2004 | Caflisch et al. | 378/65 |
| 6,757,355 | B1 * | 6/2004 | Siochi | 378/65 |
| 6,760,402 | B2 * | 7/2004 | Ghelmansarai | 378/65 |
| 7,469,035 | B2 * | 12/2008 | Keall et al. | 378/65 |
| 8,280,003 | B2 * | 10/2012 | Torsti et al. | 378/65 |
| 2002/0106054 | A1 * | 8/2002 | Caflisch et al. | 378/65 |
| 2003/0081721 | A1 * | 5/2003 | Siochi | 378/65 |
| 2004/0022363 | A1 * | 2/2004 | Ghelmansarai | 378/206 |
| 2008/0159478 | A1 * | 7/2008 | Keall et al. | 378/65 |
| 2009/0041200 | A1 * | 2/2009 | Lu et al. | 378/152 |
| 2011/0293071 | A1 * | 12/2011 | Torsti et al. | 378/152 |
| 2012/0012763 | A1 * | 1/2012 | Kuusela et al. | 250/505.1 |

OTHER PUBLICATIONS

Wikipedia_Sourcing.pdf, "Sourcing" (last modified Mar. 12, 2012), <http://en.wikipedia.org/wiki/Sourcing>.*

* cited by examiner

*Primary Examiner* — Bernard E Souw

(74) *Attorney, Agent, or Firm* — Fitch, Even, Tabin & Flannery LLP

(57) ABSTRACT

These various embodiments are employed in conjunction with the use of both a multi-leaf collimator and jaws that are interposed between a source of radiation and a treatment target while sourcing radiation from the source of radiation towards the treatment target. Generally speaking, during some portion of the aforementioned treatment, these teachings provide for manipulating the jaws to more tightly constrain, in at least one dimension, a beam-shaping aperture as is formed by the multi-leaf collimator. In many cases, as when the leaves of the multi-leaf collimator move back and forth horizontally, the foregoing can comprise manipulating the jaws in a vertical dimension

22 Claims, 4 Drawing Sheets

1000

1100

1200

1300

1400

METHOD AND APPARATUS PERTAINING TO USE OF JAWS DURING RADIATION TREATMENT

TECHNICAL FIELD

This invention relates generally to the development and/or implementation of radiation-therapy treatment plans using jaws and multi-leaf collimators.

BACKGROUND

The use of radiation to treat medical conditions comprises a known area of prior art endeavor. For example, radiation therapy comprises an important component of many treatment plans for reducing or eliminating unwanted tumors. Unfortunately, applied radiation does not discriminate between unwanted materials and adjacent tissues, organs, or the like that are desired or even critical to continued survival of the patient. As a result, radiation is ordinarily applied in a carefully administered manner to at least attempt to restrict the radiation to a given target volume.

Jaws and multi-leaf collimators are often used to restrict and form the radiation-therapy beam. Both components are typically made of high atomic numbered materials (such as tungsten) to form an effective radiation block. Jaws typically comprise two blocks that are selectively moved towards or away from one another to control the size of the gap between these two blocks. Jaws are usually either vertically oriented (in that the blocks move vertically) or horizontally oriented (in that the blocks move horizontally).

Multi-leaf collimators are comprised of a plurality of individual parts (known as "leaves") that can move independently in and out of the path of the radiation-therapy beam in order to selectively block (and hence shape) the beam. Some modern multi-leaf collimators include upwards of one hundred such leaves that can be individually moved in order to form a corresponding beam-shaping aperture. These leaves are typically used to specifically shape the radiation-therapy beam. By way of contrast, jaws are typically used to form a general frame or outer boundary around the multi-leaf collimator's beam-shaping aperture to thereby reduce leakage through the multi-leaf collimator.

Some treatment plans provide for adjusting the multi-leaf collimator to accommodate various differences that occur or accrue when, for example, moving the radiation source with respect to the target volume during a given radiation-treatment session. Though a powerful and flexible capability, unfortunately, such use of multi-leaf collimators during treatment is not wholly satisfactory for all application settings.

BRIEF DESCRIPTION OF THE DRAWINGS

The above needs are at least partially met through provision of the method and apparatus pertaining to use of jaws during radiation treatment described in the following detailed description, particularly when studied in conjunction with the drawings, wherein.

Figure 1:
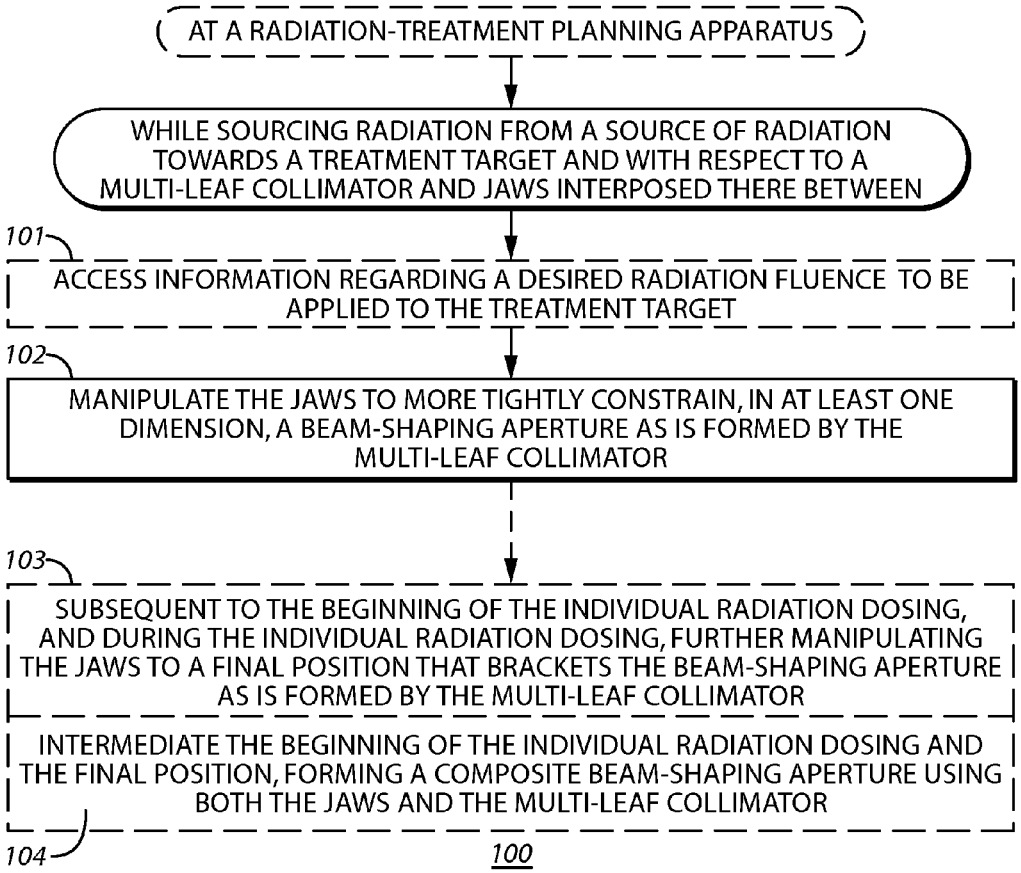
FIG. 1 comprises a flow diagram as configured in accordance with various embodiments of the invention.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

These various embodiments are employed in conjunction with the use of both a multi-leaf collimator and jaws that are interposed between a source of radiation and a treatment target while sourcing radiation (i.e., emitting radiation) from the source of radiation towards the treatment target. Generally speaking, during some portion of the aforementioned treatment, these teachings provide for manipulating the jaws to more tightly constrain, in at least one dimension, a beam-shaping aperture as is formed by the multi-leaf collimator. In many cases, as when the leaves of the multi-leaf collimator move back and forth horizontally, the foregoing can comprise manipulating the jaws in a vertical dimension.

By one approach, the foregoing can comprise using the jaws to more tightly constrain the beam-shaping aperture at the beginning of an individual radiation dosing and then further manipulating the jaws to a final position that brackets the beam-shaping aperture as is formed by the multi-leaf collimator. If desired, intermediate such positions, these teachings will accommodate forming a composite beam-shaping aperture using both the jaws and the multi-leaf collimator.

These teachings can serve, for example, to permit the jaws to more tightly constrain a beam-shaping aperture as is formed by the multi-leaf collimator when carriages as comprise the multi-leaf collimator are separated so far that the multi-leaf collimator is incapable of full-beam modulation. Similarly, these teachings can serve to permit the jaws to less tightly constrain this beam-shaping aperture when these carriages are sufficiently close to permit the multi-leaf collimator to be capable of full-beam modulation.

By one approach these teachings are implemented, at least in part, by a radiation-treatment planning apparatus. In such a case, for example, the latter can access information regarding a desired radiation fluence to be applied to a radiation-treatment target using both jaws and a multi-leaf collimator as described above. (Fluence is a measure of energy over area (i.e., the number of particles that intersect a given unit area) and reflects, more particularly, radiative flux as integrated over time. Accordingly, fluence is an important metric in dosimetry and often serves to describe the strength of a radiation field.) The radiation-treatment planning apparatus can then use this desired radiation fluence information to calculate a radiation-treatment plan that includes manipulating the aforementioned jaws to more tightly constrain, in at least one dimension and for at least part of the treatment, a beam-shaping aperture formed by the multi-leaf collimator.

The use of jaws to impinge within the beam-shaping aperture of a multi-leaf collimator may seem counterintuitive. This may especially seem so in view of the seeming courseness of the jaws as compared to the fine granularity typically associated with a multi-leaf collimator. Nevertheless, the applicant has determined that such an approach can provide superior results as compared to prior art approaches in these regards under certain application settings.

These and other benefits may become clearer upon making a thorough review and study of the following detailed description. Referring now to the drawings, and in particular to FIG. 1, an illustrative process 100 that is compatible with many of these teachings will now be presented. By one approach, this process 100 can be carried out, in whole or in part, by a radiation-treatment planning apparatus and/or a radiation-treatment administration platform. Generally speaking, a radiation-treatment planning apparatus can serve to utilize these teachings to generally or specifically plan a given radiation-treatment that includes corresponding manipulation of jaws during the treatment itself (i.e., while sourcing radiation from a source of radiation towards a treatment target).

The present teachings are readily used in conjunction with existing jaws and multi-leaf collimators. Therefore, before describing this process 100 in detail, it may be helpful to first provide additional information regarding the jaws and multi-leaf collimators that are often employed when administering a radiation treatment.

Figure 2:
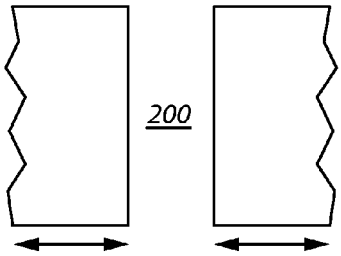
FIG. 2 Prior Art
FIG. 2 comprises a front-elevational detail schematic view as configured in accordance with the prior art.
Figure 3:
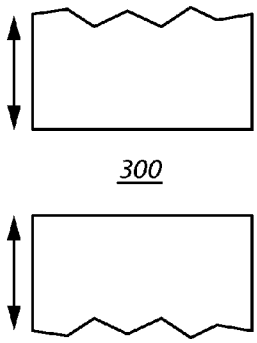
FIG. 3 Prior Art
FIG. 3 comprises a front-elevational detail schematic view as configured in accordance with the prior art.

Referring momentarily to FIG. 2, some jaws comprise horizontally-moving jaws 200. In such a case two blocks of material that comprise the jaws 200 are selectively movable back and forth to control the size of the gap there between. With reference to FIG. 3, in other cases these jaws comprise vertically-moving jaws 300. In such a case the two blocks of material that comprise the jaws 300 are selectively movable up and down to again control the size of the intervening gap. A typical application setting employing jaws utilizes both horizontally and vertically moving jaws to thereby provide an ability to generally rectangularly bracket a corresponding multi-leaf collimator's beam-shaping aperture.

Figure 4:
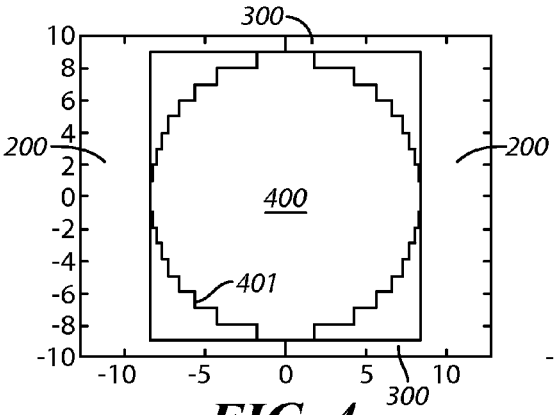
FIG. 4 Prior Art
FIG. 4 comprises a front-elevational schematic view as configured in accordance with the prior art.
Figure 5:
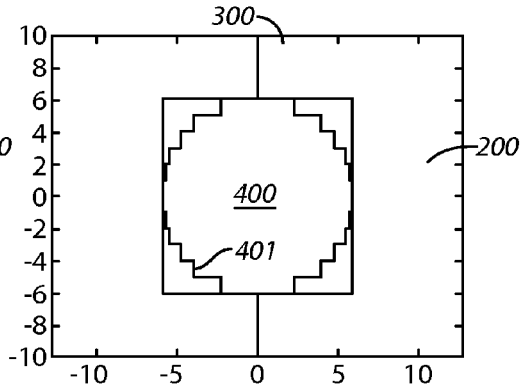
FIG. 5 Prior Art
FIG. 5 comprises a front-elevational schematic view as configured in accordance with the prior art.

Generally speaking, during many prior art treatment dosings, the boundaries of the jaws' aperture coincides with the widest part of the multi-leaf collimator's aperture. In some cases, the jaws are adjusted once during a given treatment session (to coincide with the widest opening of the multi-leaf collimator during that course of that treatment session). In other cases, the jaws are manipulated during the treatment session to maintain this bracketing orientation with respect to the multi-leaf collimator's beam-shaping aperture. By way of illustration, FIG. 4 depicts a pair of jaws 200 and 300 that are adjusted to frame the aperture 400 formed by a multi-leaf collimator 401. FIG. 5, in turn, depicts these elements at a later point during the same treatment session. Here, as the multi-leaf collimator's beam-shaping aperture 400 has become smaller as the leaves of the multi-leaf collimator 401 have been drawn inward, so too have the jaws 200 and 300 moved inwardly to continue to conformally bracket this aperture 400.

As will be shown in detail below, while these teachings will accommodate utilizing jaws in such a manner if desired, these teachings also presume to make considerably different usage of such jaws during the course of a treatment session.

Referring again to FIG. 1, when carrying out this process 100 via a radiation-treatment planning apparatus of choice, if desired, these teachings will accommodate the optional step 101 of accessing information regarding a desired radiation fluence to be applied to the radiation-treatment target when using jaws and a multi-leaf collimator that are interposed between the source of radiation and the treatment target. As will be shown below, these teachings present the very real capability of achieving fluence-defined performance goals to an extent that exceeds the capabilities of processes that do not provide for the impingement functionality described herein.

In any event, at step 102 this process 100 provides for manipulating the jaws to more tightly constrain, in at least one dimension, a beam-shaping aperture as is formed by such a multi-leaf collimator. For many application settings this can comprise manipulating the jaws in a direction that is at least substantially orthogonal to the carriages that comprise a part of the corresponding multi-leaf collimator. In many typical application settings this comprises a vertical dimension. This vertical jaw movement can result in more precise control of the vertical boundaries of the beam-shaping aperture in cases where the leaves of the multi-leaf collimator have a fixed vertical dimension and themselves move in only a horizontal direction. Depending upon the needs and/or opportunities as tend to characterize a given application setting, however, these teachings will also accommodate manipulating the jaws in essentially any direction.

By using the jaws to more tightly constrain the beam-shaping aperture that is otherwise formed by the multi-leaf collimator, these teachings presume to use the jaws, at least sometimes, as something other than a frame/bracket for the multi-leaf collimator's beam-shaping aperture. There are various potential benefits to such an approach.

As one example in these regards, but without intending any limitations in these regards, this step 102 of more tightly constraining the jaws in at least one dimension can be employed when the multi-leaf collimator carriages are separated so far apart from one another that the multi-leaf collimator is incapable of full-beam modulation. At a later point during the treatment session, when the carriages have presumably moved sufficiently close that the multi-leaf collimator is again capable of full-beam modulation, it may then be appropriate to manipulate the jaws to less tightly constrain that beam-shaping aperture.

By one approach, this step 102 of more tightly constraining the beam-shaping aperture using the jaws can occur at the beginning of an individual radiation dosing. By another approach, such in impingement can initially occur subsequent to the beginning of the dosing. The particular approach utilized will depend at least in part upon the particular needs and/or opportunities that tend to characterize a given treatment setting.

As alluded to above, these teachings will accommodate an optional step 103 that provides for following use of the jaws as described above to more tightly constrain the beam-shaping aperture (and in any event subsequent to the beginning of an individual radiation dosing but during that individual radiation dosing) by manipulating the jaws to a final position that brackets the multi-leaf collimator's beam-shaping aperture (and hence does not impinge within the aperture). As another non-limiting example in these regards, at optional step 104 this process 100 will provide for, intermediate the beginning of an individual dosing and the final position of the jaws for that dosing, forming a composite beam-shaping aperture using both the jaws and the multi-leaf collimator.

Figure 6:
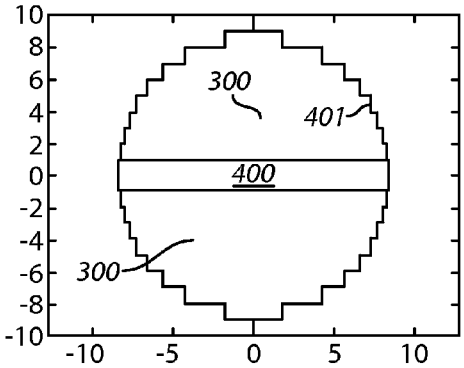
FIG. 6 comprises a front-elevational schematic view as configured in accordance with various embodiments of the invention.
Figure 7:
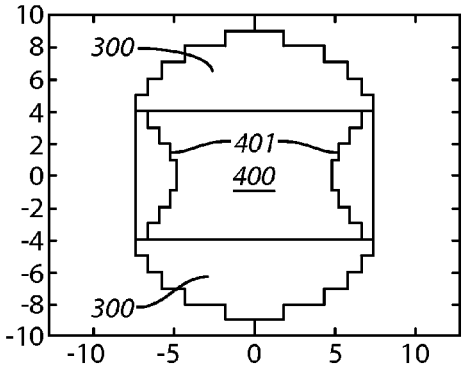
FIG. 7 comprises a front-elevational schematic view as configured in accordance with various embodiments of the invention.
Figure 8:
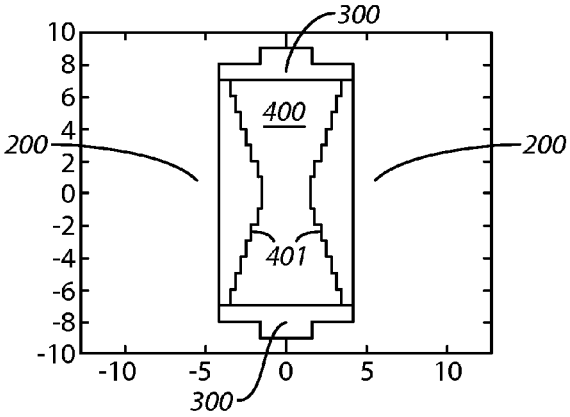
FIG. 8 comprises a front-elevational schematic view as configured in accordance with various embodiments of the invention.

An illustrative example in these regards appears sequentially in FIGS. 6, 7, and 8. In FIG. 6 (which might depict, for example, the position of both the vertical jaws 300 and a corresponding multi-leaf collimator 401 at the beginning of an individual dosing) the beam-shaping aperture 400 is bounded on its sides by leaves of the multi-leaf collimator 401 but has a top and bottom defined by the vertical jaws 300 which are impinging well within the aperture formed by the multi-leaf collimator 401 alone. FIG. 7 then depicts these same components a few moments later during the same individual dosing. Here, the vertical jaws 300 have moved further apart from one another but now less tightly constrain the beam-shaping aperture 400. At the same time, central leaves of the multi-leaf collimator 401 are now extended further inwardly. In FIG. 8 the vertical jaws 300 and the horizontal jaws 200 have both moved into bracketing positions for the multi-leaf collimator's beam-shaping aperture.

Figure 9:
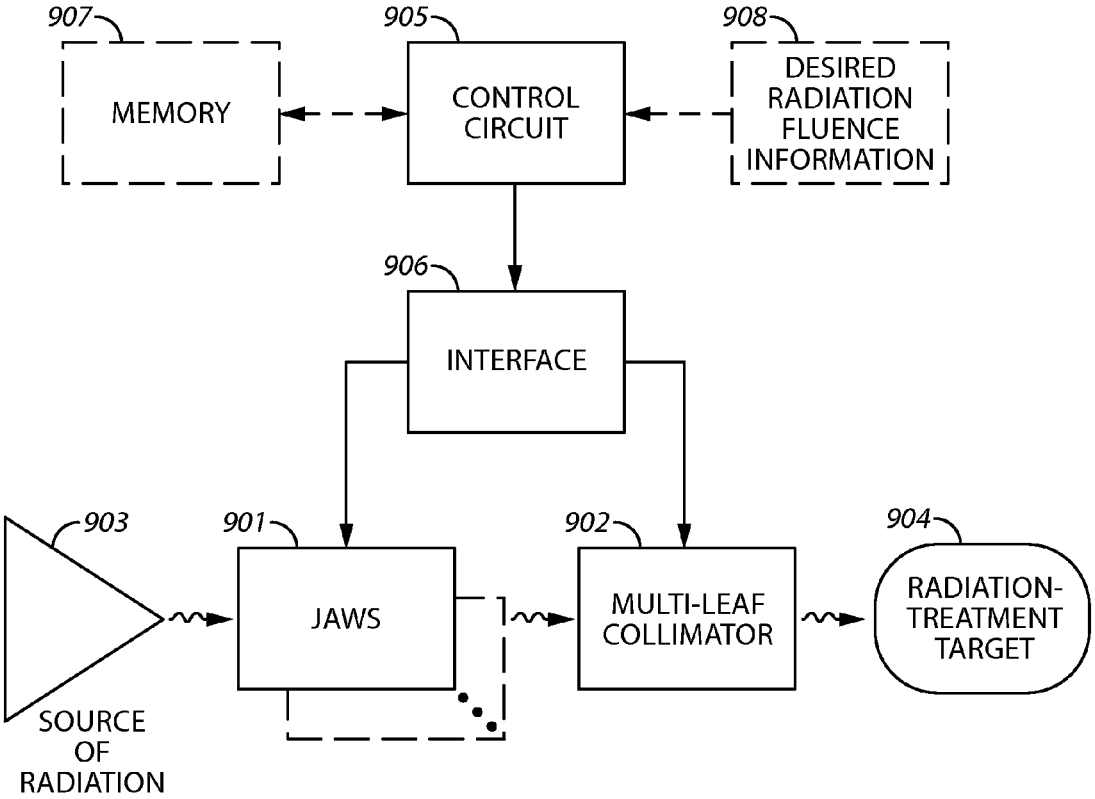
FIG. 9 comprises a block diagram as configured in accordance with various embodiments of the invention.

The above-described processes are readily enabled using any of a wide variety of available and/or readily configured platforms, including partially or wholly programmable platforms as are known in the art or dedicated purpose platforms as may be desired for some applications. Referring now to FIG. 9, an illustrative approach to such a platform will now be provided.

In this example, one or more jaws 901 and at least one multi-leaf collimator 902 are interposed between a source of therapeutic radiation 903 and a corresponding radiation-treatment target 904 (such as a particular portion of a patient's body; for example, an internal-located tumor). So configured, a radiation beam from the source of radiation 903 must pass through the beam-shaping aperture formed by the jaws 901 and/or the multi-leaf collimator 902 as described above.

In this illustrative example a control circuit 905 controls the jaws 901 and multi-leaf collimator 902 via a corresponding interface 906. Such configurations are generally well known in the art and require no further elaboration here. Such a control circuit 905 can comprise a fixed-purpose hard-wired platform or can comprise a partially or wholly programmable platform. All of these architectural options are also well known and understood in the art and require no further description here. In this example, the control circuit 905 can comprise part of a radiation-treatment administration apparatus. As mentioned above, however, this control circuit 905 might comprise instead a radiation-treatment planning apparatus (in which case the control circuit 905 might not itself directly control the jaws 901 and/or the multi-leaf collimator 902).

Particularly in the case where the control circuit 905 comprises at least a partially programmable platform (such as a computer) the control circuit 905 can itself further comprise, or can connect to, one or more memories 907. Such a memory 907 can serve to store, for example, instructions that, when executed by the control circuit 905, cause the latter to carry out one or more of the steps, actions, and/or functions described herein. As another example, this memory 907 can serve to store the treatment plan that is carried out by the control circuit 905.

As noted earlier, these teachings will accommodate accessing desired radiation fluence information. Such information can be used, for example, to inform the development of the plan for moving the jaws 901 in accordance with these teachings in order to achieve a particular fluence-based result. To support such an approach, FIG. 9 therefore also depicts an optional storage mechanism 908 that contains such information and provides such information to the control circuit 905.

Figure 10:
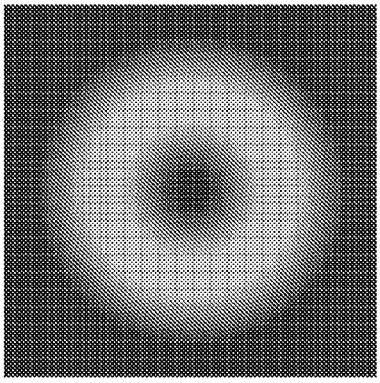
FIG. 10 comprises a grayscale depiction of a target conical target fluence.

The potency of these teachings with respect to achieving fluence-based goals will now be illustrated. To begin, FIG. 10 represents an illustrative example of desired conical target fluence 1000. That is, this is a representation of fluence if ideally administered as per a given treatment.

Figure 11:
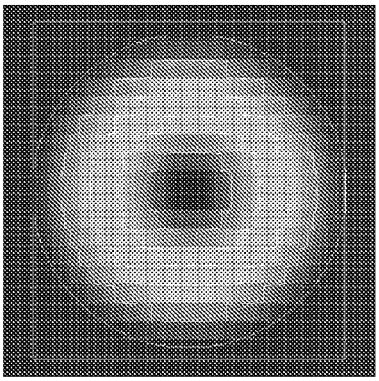
FIG. 11 Prior Art
FIG. 11 comprises a grayscale depiction of resultant fluence in accordance with the prior art.
Figure 12:
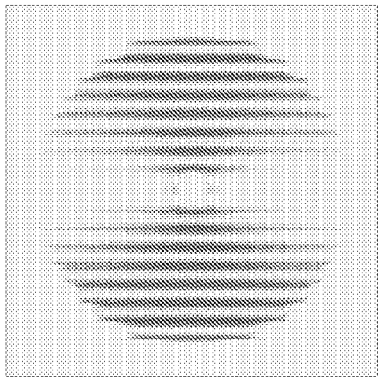
FIG. 12 Prior Art
FIG. 12 comprises a grayscale depiction of the difference between the target fluence of FIG. 10 and the resultant fluence of FIG. 11.

FIG. 11 depicts the fluence 1100 that results by one prior art approach when permitting the jaws to move during dosing but without impinging within the beam-shaping aperture. While the fluence 1100 of FIG. 11 bears some relationship to the target fluence 1000 depicted in FIG. 10, it is also clear that there is considerable room for improvement. FIG. 12, in fact, depicts the difference 1200 between the target fluence 1000 and this resultant fluence 1100. The sum of the absolute difference between the pixel values of these two fluences equals, in this example, 472.

Figure 13:
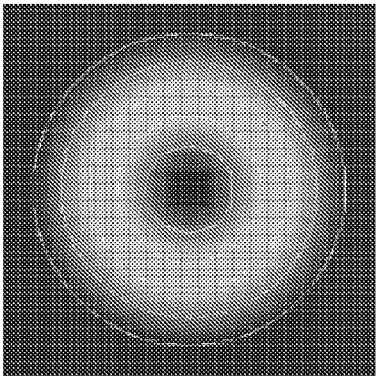
FIG. 13 comprises a grayscale depiction of the resultant fluence in accordance with various embodiments of the invention.
Figure 14:
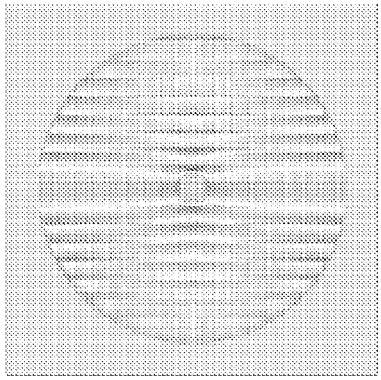
FIG. 14 comprises a grayscale depiction of the difference between the target fluence of FIG. 10 and the resultant fluence of FIG. 13.

FIG. 13, however, depicts the fluence 1300 that results when permitting the jaws to not only move during dosing but also to impinge within the beam-shaping aperture in an appropriate manner. More particularly, this resultant fluence 1300 corresponds to the treatment plan exemplified in FIGS. 6-8 as described above. Though not a perfect match for the target fluence 1000, there is clear improvement. FIG. 14 helps to quantify this improvement by presenting the difference 1400 between the resultant fluence 1300 of FIG. 13 and the target fluence 1000. Here, the sum of the absolute difference between the pixel values of these two fluences equals, in this example, only 115.

So configured, these teachings permit existing components to be further leveraged in a manner that can yield considerably better results under some operating circumstances than many traditional approaches. Manipulating the jaws will likely not increase treatment times and, in fact, may result in shorter treatment windows in some cases. As these teachings can be exploited without requiring additional or modified hardware elements, these teachings can be fielded in a very inexpensive and economical manner. That said, it seems likely that jaws that are newly designed to further exploit these capabilities may further extend the utility and value of these teachings.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A method for use with a multi-leaf collimator and jaws interposed between a source of radiation and a treatment target while sourcing radiation from the source of radiation towards the treatment target, comprising:

manipulating the jaws to more tightly constrain, in at least one dimension, a beam-shaping aperture as is formed by the multi-leaf collimator.

2. The method of claim 1 wherein manipulating the jaws comprises manipulating the jaws in a vertical dimension.

3. The method of claim 1 wherein manipulating the jaws to more tightly constrain, in at least one dimension, a beam-shaping aperture as is formed by the multi-leaf collimator comprises manipulating the jaws to more tightly constrain, in at least one dimension, a beam-shaping aperture as is formed by the multi-leaf collimator at a beginning of an individual radiation dosing.

4. The method of claim 3 further comprising:

subsequent to the beginning of the individual radiation dosing, and during the individual radiation dosing, further manipulating the jaws to a final position that brackets the beam-shaping aperture as is formed by the multi-leaf collimator.

5. The method of claim 4 further comprising:

intermediate the beginning of the individual radiation dosing and the final position, forming a composite beam-shaping aperture using both the jaws and the multi-leaf collimator.

6. The method of claim 1 wherein the at least one dimension comprises a dimension that is at least substantially orthogonal to carriages that comprise a part of the multi-leaf collimator.

7. The method of claim 1 wherein manipulating the jaws to more tightly constrain, in at least one dimension, a beam-shaping aperture as is formed by the multi-leaf collimator comprises:

manipulating the jaws to more tightly constrain, in at least one dimension, a beam-shaping aperture as is formed by the multi-leaf collimator when carriages that comprise the multi-leaf collimator are separated so far that the multi-leaf collimator is incapable of full-beam modulation;

manipulating the jaws to less tightly constrain, in the at least one dimension, the beam-shaping aperture when the carriages are sufficiently close that the multi-leaf collimator is capable of full-beam modulation.

8. An apparatus for use with a multi-leaf collimator and jaws interposed between a source of radiation and a treatment target, comprising:

an interface coupled to the multi-leaf collimator and the jaws;

a control circuit operably coupled to the interface and being configured to manipulate, while sourcing radiation from the source of radiation towards the treatment target, the jaws to more tightly constrain, in at least one dimension, a beam-shaping aperture as is formed by the multi-leaf collimator.

9. The apparatus of claim 8 wherein the control circuit is configured to manipulate the jaws by manipulating the jaws in a vertical dimension.

10. The apparatus of claim 8 wherein the control circuit is configured to manipulate the jaws to more tightly constrain, in at least one dimension, a beam-shaping aperture as is formed by the multi-leaf collimator by manipulating the jaws to more tightly constrain, in at least one dimension, a beam-shaping aperture as is formed by the multi-leaf collimator at a beginning of an individual radiation dosing.

11. The apparatus of claim 10 wherein the control circuit is further configured to, subsequent to the beginning of the individual radiation dosing, and during the individual radiation dosing, further manipulate the jaws to a final position that brackets the beam-shaping aperture as is formed by the multi-leaf collimator.

12. The apparatus of claim 11 wherein the control circuit is further configured to, intermediate the beginning of the individual radiation dosing and the final position, form a composite beam-shaping aperture using both the jaws and the multi-leaf collimator.

13. The apparatus of claim 11 wherein the control circuit is further configured to manipulate the jaws to more tightly constrain, in at least one dimension, a beam-shaping aperture as is formed by the multi-leaf collimator when carriages that comprise the multi-leaf collimator are separated so far that the multi-leaf collimator is incapable of full-beam modulation;

manipulate the jaws to less tightly constrain, in the at least one dimension, the beam-shaping aperture when the carriages are sufficiently close that the multi-leaf collimator is capable of full-beam modulation.

14. A method comprising:

at a radiation-treatment planning apparatus:

accessing information regarding a desired radiation fluence to be applied to a radiation-treatment target using jaws and a multi-leaf collimator that are interposed between a source of radiation and a treatment target;

using the desired radiation fluence to calculate a radiation-treatment plan that includes manipulating the jaws to more tightly constrain, in at least one dimension, a beam-shaping aperture as is formed by the multi-leaf collimator.

15. The method of claim 14 wherein manipulating the jaws comprises manipulating the jaws in a vertical dimension.

16. The method of claim 14 wherein manipulating the jaws to more tightly constrain, in at least one dimension, a beam-shaping aperture as is formed by the multi-leaf collimator comprises manipulating the jaws to more tightly constrain, in at least one dimension, a beam-shaping aperture as is formed by the multi-leaf collimator at a beginning of an individual radiation dosing.

17. The method of claim 16 wherein using the desired radiation fluence to calculate a radiation-treatment further comprises using the desired radiation fluence to calculate a radiation treatment that, subsequent to the beginning of the individual radiation dosing, and during the individual radiation dosing, provides for further manipulating the jaws to a final position that brackets the beam-shaping aperture as is formed by the multi-leaf collimator.

18. The method of claim 17 wherein using the desired radiation fluence to calculate a radiation-treatment further comprises using the desired radiation fluence to calculate a radiation treatment that, intermediate the beginning of the individual radiation dosing and the final position, forms a composite beam-shaping aperture using both the jaws and the multi-leaf collimator.

19. A method for use with a multi-leaf collimator and jaws interposed between a source of radiation and a treatment target, comprising:

manipulating the jaws to more tightly constrain, in at least one dimension, a beam-shaping aperture as is formed by the multi-leaf collimator when carriages that comprise the multi-leaf collimator are separated so far that the multi-leaf collimator is incapable of full-beam modulation;

manipulating the jaws to less tightly constrain, in the at least one dimension, the beam-shaping aperture when the carriages are sufficiently close that the multi-leaf collimator is capable of full-beam modulation.

20. The method of claim 19 wherein manipulating the jaws comprises manipulating the jaws in a vertical dimension.

21. The method of claim 19 wherein manipulating the jaws comprises manipulating the jaws in a dimension that is at least substantially orthogonal to a direction of movement of the carriages.

22. The method of claim 19 wherein manipulating the jaws to less tightly constrain, in the at least one dimension, the beam-shaping aperture when the carriages are sufficiently close comprises manipulating the jaws such that the jaws do not constrain the beam-shaping aperture.

* * * * *